United States Patent [19]

Scott

[11] 4,086,903

[45] May 2, 1978

[54] TENNIS BALL THROWING MACHINE

[76] Inventor: Jack C. Scott, 8547 Amestoy Ave., Northridge, Calif. 91324

[21] Appl. No.: 676,410

[22] Filed: Apr. 13, 1976

[51] Int. Cl.[2] ..... A63B 69/40

[52] U.S. Cl. ..... 124/78; 318/67; 318/99

[58] Field of Search ..... 124/78, 8, 9, 48, 82, 124/16; 318/67, 68, 99, 305; 248/188.5

[56] References Cited

U.S. PATENT DOCUMENTS

| | | | |
|---|---|---|---|
| 2,698,442 | 1/1955 | Travis | 248/188.5 X |
| 3,421,491 | 1/1969 | Brown | 124/9 |
| 3,610,223 | 10/1971 | Green | 124/16 |
| 3,646,414 | 2/1972 | Gurwicz | 318/67 |
| 3,724,437 | 4/1973 | Halstead | 124/78 |
| 3,777,732 | 12/1973 | Holloway et al. | 124/78 |
| 3,794,011 | 2/1974 | Newgarden | 124/78 |
| 3,913,552 | 10/1975 | Yarur et al. | 124/78 |
| 3,962,615 | 6/1976 | Spangler | 318/305 |

FOREIGN PATENT DOCUMENTS

| | | | |
|---|---|---|---|
| 2,262,880 | 6/1974 | Germany | 124/78 |

*Primary Examiner*—Anton O. Oechsle

*Attorney, Agent, or Firm*—Blakely, Sokoloff, Taylor & Zafman

[57] ABSTRACT

A tennis ball throwing machine for use in the practice of tennis having the capability of controllably delivering tennis balls to a player's forehand and backhand at various speeds and with various spins simulating conditions commonly encountered in game play. The machine has a pair of wheels which are independently and controllably driven so as to throw a tennis ball delivered therebetween by an automatic ball feed mechanism at a speed and with a spin determined by the speed of each of the wheels. Various features include an oscillating system to alternate pitches between the forehand and backhand in a controllable manner, an elevation adjustment mechanism for controllably varying the height of the delivery or providing a random variation in such height, and independent ball speed and ball spin controls. Remote controls for the machine may be provided.

11 Claims, 16 Drawing Figures

SPEED
SPIN
115 VAC

TENNIS BALL THROWING MACHINE

BACKGROUND OF THE INVENTION

1. Field of the Invention

The present invention relates to the field of sports equipment, and more particularly to the field of devices for the delivery of tennis balls to facilitate the practice of the basic tennis strokes.

2. Prior Art

Various types of ball throwing machines are well known in the prior art. Examples of such machines include baseball throwing machines and tennis ball throwing machines, which have been used for batting practice and the practice of the basic tennis ground strokes, respectively.

The ball throwing machines and machines for throwing other objects known in the prior art have utilized various throwing mechanisms. By way of example, throwing arms and slides have been utilized for throwing balls, clay pigeons and the like. Also compressed air and spinning wheels for receiving a ball therebetween have been used for the pitching of balls. However, tennis ball throwing machines having the various functions and controls of the present invention and being relatively inexpensive to manufacture are not known in the prior art.

In the case of tennis ball throwing machines, various functions and characteristics are highly desired. The basic function, of course, is to throw a tennis ball for the return by a player, preferably over a net on a standard tennis court. Accordingly, it is desired to have the machine be portable for easy transport and removal from a court, and further that the machine not require permanent anchors of any kind. Also, since the skill of the people using a machine will vary considerably, and in fact, normal play will involve various speeds, spins, positions, etc. it is desirable to be able to vary both the basic speed of the throw and the spin placed on the ball e.g., preferably varying amounts of forward spin and back spin. Other features of an ideal machine would include some form of oscillation of the throws from side to side so as to provide practice shots, both to the user's forehand and backhand, if desired, most preferably with varying rates of ball delivery and varying angular excursions between the forehand and the backhand throw. Additional features might include a variable height in the throws, such as by way of a mechanical adjustment of the device, or more preferably by way of a readily controllable or even a random variation in the height of the pitches, varying between controllable limits. In some instances a remote control is preferred in order to provide maximum diversity in the throws without requiring frequency adjustments at the machine itself. It is therefore these various desired characteristics and objectives to which the present invention is directed.

BRIEF SUMMARY OF THE INVENTION

A tennis ball throwing machine for use in the practice of tennis having the capability of controllably delivering tennis balls to a player's forehand and backhand at various speeds and with various spins simulating conditions commonly encountered in game play. The machine has a pair of wheels which are independently and controllably driven so as to throw a tennis ball delivered therebetween at a speed and with a spin determined by the speed of each of the wheels. An automatic ball feed mechanism is provided for delivering tennis balls to the throwing wheels. An oscillating system is provided to alternate pitches between the forehand and backhand in a controllable manner, with an adjustment being provided for the elevation of the delivery. The entire mechanism is mounted on a cart-like assembly for easy moving, with an alternate embodiment providing remote control of ball speeds, spins and direction of delivery, and further including a random variation in the height of the delivery. An embodiment having independent ball speed and ball spin controls is disclosed.

BRIEF DESCRIPTION OF THE DRAWINGS

FIG. 11 is a partial side view of the alternative embodiment of the ball throwing machine.

FIG. 12 is a view taken along section line 12—12 of FIG. 11.

FIG. 13 is a view of the support for the forward end of the alternative embodiment ball throwing machine taken along section line 13—13 of FIG. 12.

FIG. 14 is a view taken along section line 14—14 of FIG. 13.

FIG. 15 is a view taken along section line 15—15 of FIG. 11.

DETAILED DESCRIPTION OF THE INVENTION

Figure 1:
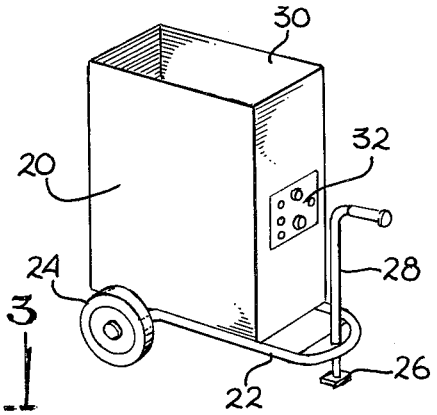
FIG. 1 is a perspective of the tennis ball throwing machine of the present invention.

First referring to FIG. 1, a perspective view of one embodiment of the present invention may be seen. The machine of the present invention is characterized by a rectangular body 20 supported on a frame assembly 22 having a pair of wheels 24 (only one being visible in FIG. 1), and a forward support pad 26 with a handle 28 thereabove to allow easy and convenient movement and relocation of the device. The top region 30 is generally open to receive a supply of tennis balls, with a control panel 32 at the front of the device providing various controls for the device to control delivery speed, spin and delivery rate. As shall subsequently be described in detail, other adjustments and controls include the control of the elevation of the balls being delivered by the device and the angle of sweep between forehand shots and backhand shots if desired.

Figure 2:
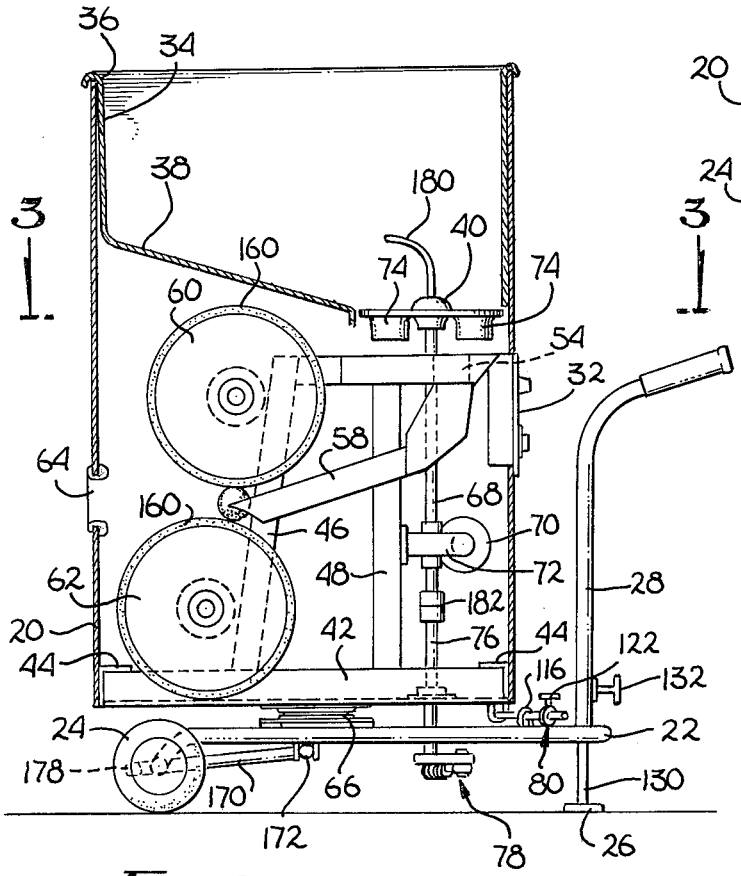
FIG. 2 is a side view of the machine of FIG. 1 with the side cut away.

Now referring to FIG. 2, a side view of the apparatus of the present invention, with the facing panels cut away, may be seen. This view illustrates the basic operative parts of the machine and their cooperation to achieve the desired results. The rectangular body 20, in the preferred embodiment a fiberglass member, provides a decorative enclosure for the mechanism therewithin, and supports at the top thereof an open bin 34 for receiving a supply of tennis balls. The bin 34 has an upper hook-like lip 36 for fastening to the top edge of the body 20, and further has a sloping bottom surface 38 to encourage tennis balls toward a delivery wheel 40. Within the body enclosure is a generally welded frame assembly fabricated of sheet metal angle and channel members. In particular, a main horizontal channel member 42 supports a pair of angle members 44 at each end thereof which may be fastened to the base of the body member 20. Welded to the channel member 42 are a pair of generally upright channel members 46 and 48 joined at the top thereof by an additional channel member 50. An additional channel member 52 is welded to the side of channel member 50 and has a hole 54 the size of a tennis ball therethrough. A chute fabricated of sheet metal members 56 and 58 is disposed under the hole 54 in channel member 52, and delivers tennis balls passing therethrough to a position between wheels 60 and 62. The wheels 60 and 62 are independently driven by motors supported on channel members 46 and controlled through controls on a control panel 64 to accelerate the tennis balls delivered thereto to a speed dependent upon the average speed of the two wheels and to apply spin thereto dependent upon the difference in speed between the two wheels. The tennis balls in turn are propelled out of the opening 64 in the body 20.

The entire assembly hereabove described is supported on the frame assembly 22 through a large ball thrust bearing 66 so as to be rotatable about the vertical axis through the thrust bearing. The delivery wheel 40 is supported on a shaft 68 and driven in rotation through a variable speed motor 70 and gear reduction drive 72. The delivery wheel has a pair of generally cylindrical openings 74, each of which are of a size to just receive one tennis ball so as to deposit that ball through hole 54 and into the chute upon rotation thereby. Accordingly, twice each rotation of shaft 68, the device will effectively take one ball from the bin 34 and propel the ball at a relatively high speed out of the opening 64. Also coupled to the gear reduction drive 72 is a shaft assembly 76 rotating at the same speed as shaft 68 and driving a crank assembly, generally indicated by the numeral 78, so as to cause the oscillation of the entire ball throwing assembly, that is the assembly within body 20, about a vertical axis on the thrust bearing 66. Two balls are thrown on each oscillation, one of which will be generally thrown to a player's forehand and the other of which will be generally thrown to the player's backhand. The oscillatory motion however, in this embodiment may be restricted or terminated by an assembly generally indicated by the numeral 80 in a manner which will subsequently be more fully described.

Figure 3:
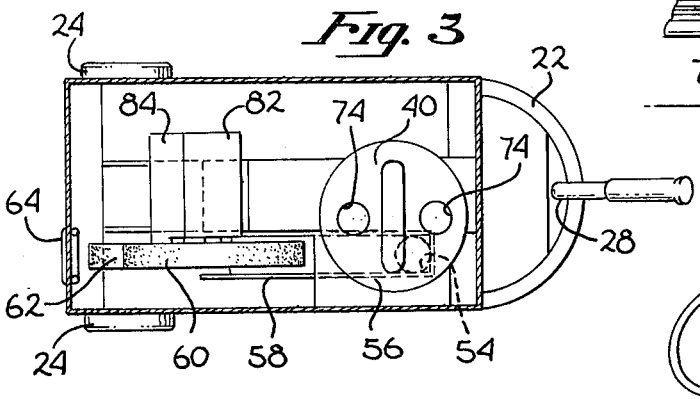
FIG. 3 is a top view of the machine taken along section line 3—3 of FIG. 2.

Now referring to FIG. 3, a partial cross-section taken along line 3—3 of FIG. 2 may be seen. This FIGURE illustrates the general disposition of the opening 54 with respect to the chute members 58 and 56 and the periodic alignment of the opening with the openings 74 in the delivery wheel 40. Also illustrated in this FIGURE are the wheels 60 and 62 supported from variable speed motors 82 and 84 bolted to channel member 46, supporting the wheels in general alignment with the chute and opening 64 in the body 20.

Figure 4:
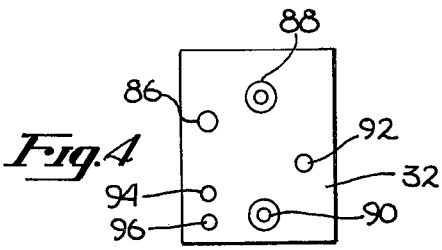
FIG. 4 is a face view of the control panel 32 of the machine of FIG. 1.

Now referring to FIG. 4, a face view of the control panel 32 may be seen. The various controls comprise an ON/OFF switch 86 and speed controls 88, 90 and 92 for motors 82, 84 and 70, respectively. These motor speed controls in the preferred embodiment comprise conventional controls for SCR motor speed control circuits, mounted within the panel assembly, so as to allow independent adjustment of the speed of wheels 60 and 62, and also to allow independent adjustment of the rate of oscillation between forehand and backhand shots. Also provided on this panel are fuses 94 and 96 for short circuit and overload protection.

Figure 5:
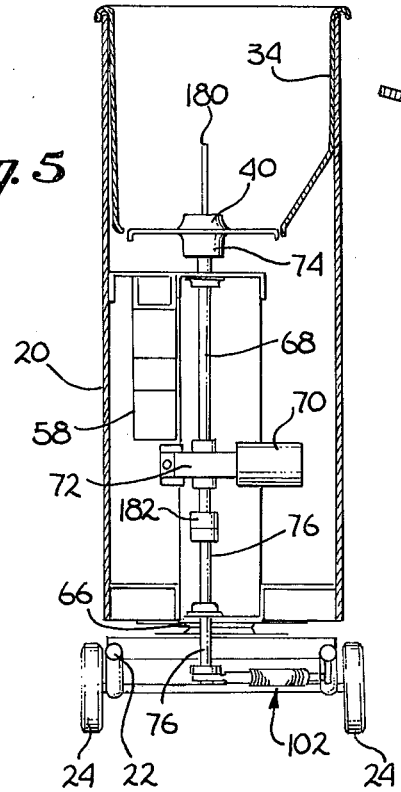
FIG. 5 is an end view of the machine with the end panel cut away.
Figure 7:
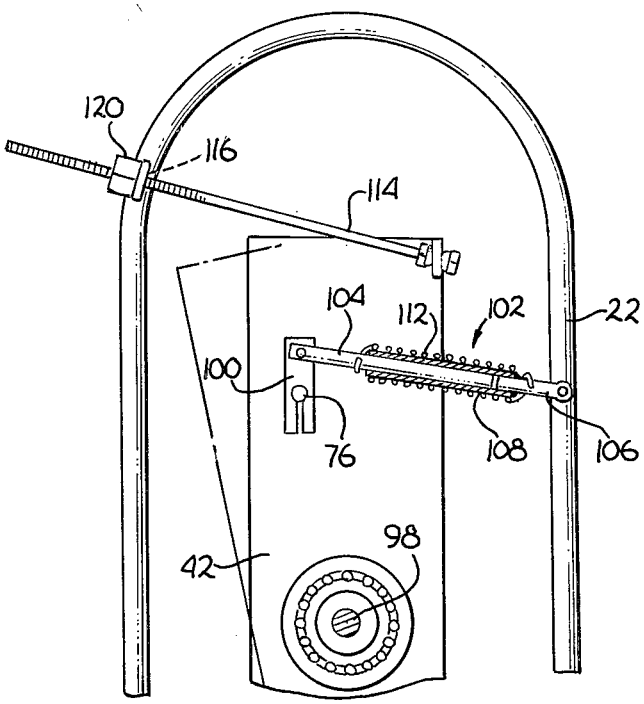
FIG. 7 is a view taken on an expanded scale showing a portion of the bottom of the machine.
Figure 6:
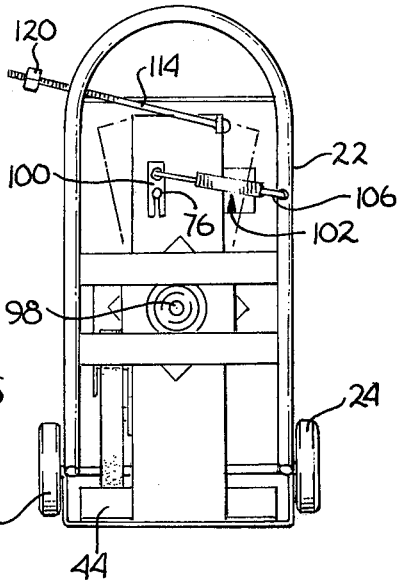
FIG. 6 is a bottom view of the machine.

Now referring to FIGS. 5, 6 and 7, additional details of the device including the mechanism for controlling the oscillation between forehand and backhand shots will now be described. It will be noted that the axes of shaft assemblies 68 and 76 are disposed slightly off center and accordingly the bin member 34 is shaped to provide for that fact. More important, however, is the fact that the axes of the shaft assemblies 68 and 76 (see FIG. 6) are substantially displaced from the axis 98 of the thrust bearing 66. Fastened to the lower end of shaft 76 is a lever 100 connected to the frame 22 through a connecting assembly, generally indicated by the numeral 102. This connecting assembly is comprised of a shaft 104 pivotally coupled to the lever 100, and a second shaft portion 106 pivotally coupled to the frame 22. A section of tubing 108 is welded to shaft 106 in region 110 so that shaft 104 is free to slide within the steel tubing 108 when called upon to do so. A tension spring 112 has its ends coupled to shafts 104 and 106 so as to yieldably encourage shaft 104 into a bottoming position against shaft 106 in the steel tube 108. Accordingly for unrestricted motion, the entire assembly will oscillate back and forth through an angle determined primarily by the length of the lever arm 100 and the separation between the shaft assembly 76 and the axis 98 of the thrust bearing. However, an adjustment mechanism, best illustrated in FIGS. 2 and 7, is provided for this motion. In particular, a rod 114 is coupled to the base channel member 42 of the oscillating assembly and extends through a loop 116 welded to the frame 22. A sleeve 120 is disposed on the outer portion of rod 114, with a thumb screw 122 allowing the locking of the sleeve 120 at any desired position on the rod. Accordingly the interception of the sleeve 120 by loop 116 and the frame 122 limits the travel of the assembly in one direction, more particularly in the direction wherein the drive is accomplished by tension in the connecting assembly 102. Since further motion in this direction is prevented by the adjustment, shaft 104 momentarily slides outward part way from the cylindrical member 108 under the tension of the coil spring 112, with the oscillatory motion being resumed upon the return of rod 104 to its bottomed position.

Figure 8:
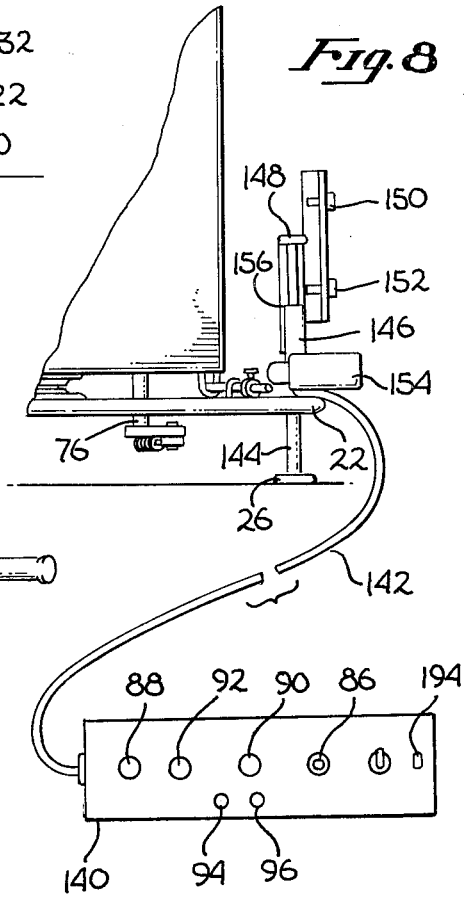
FIG. 8 is a side view illustrating the remote control for the machine, including a remote elevation control.

The embodiment hereinbefore described is intended for control at the device itself. Thus, in addition to the speed and spin controls through the controls for the speed of wheels 60 and 62, the oscillation extent (angle) of the device, and the rate of throwing (and oscillation), the elevation of the throw itself may be adjusted through the use of the adjustable stand comprising the shaft 130 of stand 26 slidably fitting within the tubular handle 28, with a locking thumb screw 132 being provided for the locking of the stand at any desired position. However, the present invention may also be constructed in a remote control configuration, as illustrated generally in FIG. 8 and in certain details in FIGS. 9 and 10. In particular, the control panel 32 in the remote control embodiment is basically removed from the fiberglass body 20 and provided in a remote control panel 140 (see FIG. 8) coupled to the device through a cable 142.

Also, in this alternate embodiment an additional feature is incorporated, that is, an adjustment of the throwing elevation which may be remote controlled or which may be controlled so as to be random in relation to the throws. In particular, the stand 26 of this embodiment is supported on a shaft 144 sliding within a short steel tubular member 146 welded to the frame assembly 22, with the top of the shaft 144 having an enlarged top cap 148 which may intercept the switch members on an upper switch 150 and a lower switch 152. A gear motor 154 fastened to the frame assembly 22 drives a pulley tied to a coupling line 156 which in turn is coupled to member 148 on shaft 144 so as to provide a motorized drive for the height of the stand at the front of the device. The switches 150 and 152 are reversing switches, so that a simple ON/OFF switch, such as switch 158 on the remote control box, can be used to turn on motor 154. While the motor is on the height will oscillate between limits determined by the position of switches 150 and 152, preferably adjustable positions, or in the alternative, may be adjusted to any fixed position by turning switch 158 off when the desired position is reached. The variation in height will be random, or course, as motor 154 is not synchronized to motor 70 in the preferred embodiment. (The remaining controls, fuses, etc. coincide with the controls of the control panel 32 shown in detail in FIG. 4.)

There has so far been described in detail herein two embodiments of a tennis ball throwing machine which allow the easy control of speed, elevation, angle, frequency and spin of the thrown balls. Also one embodiment has been described herein having an automatic elevation control, and featuring the addition capability of a constantly varying and random elevation in the thrown balls. In the preferred embodiment, wheels 60 and 62 are provided with a urethane rim region 160 which helps provides significant inertia to the wheels and grips the tennis balls well without significant abrasion therewith. In that regard, the spacing of the wheels is such as to result in slight compression of the tennis balls to assure the positive gripping thereof. In the preferred embodiment, ball speeds of one hundred miles per hour and higher are readily achieved without difficulty. Also, as shown in FIG. 2, the preferred embodiments include a stand comprised of tubular members 170 pivoted on the axle of wheels 24 and having a cross tubular member 172 which may be temporarily retained by spring clips 176 welded to the frame assembly 22. This stand, however, may be swung downward so that the entire device rests on the stand and the forward pad 26, with an aft cross bar 178 providing a stop for the motion of the stand by interception of the frame 22. Other features of the device include a curved arm-like member 180 coupled to the top of the delivery wheel 40 which serves as an agitator for the tennis balls in the bin 34 to assure the constant and proper feeding of the delivery wheel 40.

Figure 9:
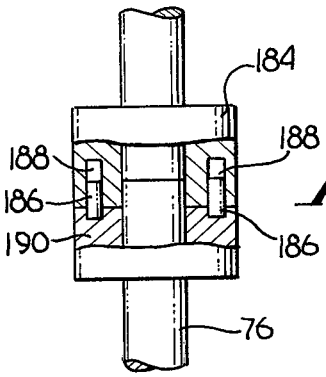
FIGS. 9 and 10 are partial cross sections taken at right angles to each other of the unidirectional clutch which may be incorporated with the present invention.
Figure 10:
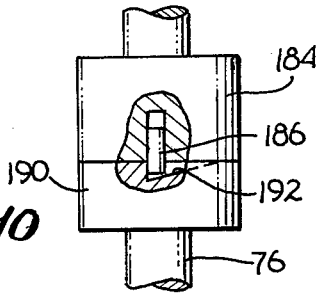

Other features which may be used with either embodiment include a simple one-way or unidirectional clutch shown in FIGS. 9 and 10 which may be used in place of the simple coupling 182. This one-way clutch comprises an upper member 184 having a pair of pins 186 slidably engaging holes 188 therein. A lower member 190 has a pair of inclined grooves 192 in the face thereof into which pins 186 may fall. Accordingly, on rotation of the upper shaft in one direction the lower shaft will be positively driven, having a fixed angle of reference for the drive in relation to the two openings in the delivery wheel as a result of the two pins or dogs 186. However, the drive of the lower shaft is disconnected from the drive of the upper shaft upon the rotation of the upper shaft in the opposite direction. Accordingly, a simple reversing switch 194 may be incorporated, by way of example, in the remote control apparatus which will stop the oscillation of the assembly yet will not interrupt the throwing of the balls since the throwing system is not sensitive to the direction of rotation of the delivery wheel.

Now referring to FIGS. 11 through 15, various views of an alternate embodiment may be seen. This embodiment may be identical to the foregoing described embodiments with respect to the main ball throwing apparatus, generally indicated by the numeral 200. The lower frame assembly, however, is substantially different, having certain advantages with respect to ease of movement and adjustment for height of throw. In this embodiment a tubular frame member 202 curves upward at the rear of the machine to provide a handle, generally above a pair of wheels **24*a* supported on an axle 204 welded to the tubular members 202 (the various parts identified by a numeral followed by a letter are similar in design and function to the parts having the same numeral and previously described with respect to prior embodiments). The tubular member 202 projects forward under the assembly 200 to support the large thrust bearing 66 through frame members 206 and 208. Welded to frame member 206 is a tube 210 (see particularly FIG. 13) having disposed within the tube member a threaded steel rod 212 forming, at the lower end thereof, a stand or support for the forward end of the machine, and having at the top thereof a compression spring 214 retained by cap 216. Thus, coil spring 214 encourages rod 212** to a lower position, with the spring force preferably being selected to approximately balance the front of the machine.

For control of the position of rod 212, a spring loaded hinge member 218 is fastened to frame member 206. The spring loaded hinge member has an extension arm 220 thereon, with a segment of a nut 222 welded thereto so as to be engageable with the threads on the rod 212 (see FIG. 14). Accordingly, the spring loaded hinge 218 encourages the nut 222 into engagement with rod 212 to lock the rod at a fixed position of extension, and thus the machine at a fixed angular elevation.

Located within the tubular member 202 is an actuating cable 224 of the same type commonly used with respect to caliper brakes and shifting mechanisms for ten-speed bicycles, which in turn is controlled by a handle grip assembly 226 (see FIG. 15), which in fact may be a bicycle brake actuator. The other end of the cable 224 is coupled to the outer end of member 220 so that when the hand grip 228 is actuated, member 220 and thus the engaging member 222 is moved away from shaft 212 to allow the shaft to move to a new position dependent upon the encouragement of the user. The resulting assembly is highly stable, needing no further anchoring during operation of the machine, and is easy to move and adjust, particularly as a result of the compression spring 214 which avoids an immediate dropping of the machine on actuation of the release mechanism. If desired, coil spring 214 may be coupled to both the top of shaft 212 and the top of tube member 210 so that the shaft 212 is positively retained within the tube.

Also in this embodiment the adjustment mechanism limiting the angular sweep of the throws is raised to a more convenient elevation. In particular, a crossbar 230 (FIG. 15) is welded between the upright portions of tubular member 202 just below the top thereof, which bar is straddled by a member 232 coupled to the upper portion of the throwing assembly 200. Accordingly a simple stop member 234 with thumb locking screw 236 provides a conveniently located and easily adjustable stop for this adjustment.

Figures 11, 12, 13, 14, 15, 16:
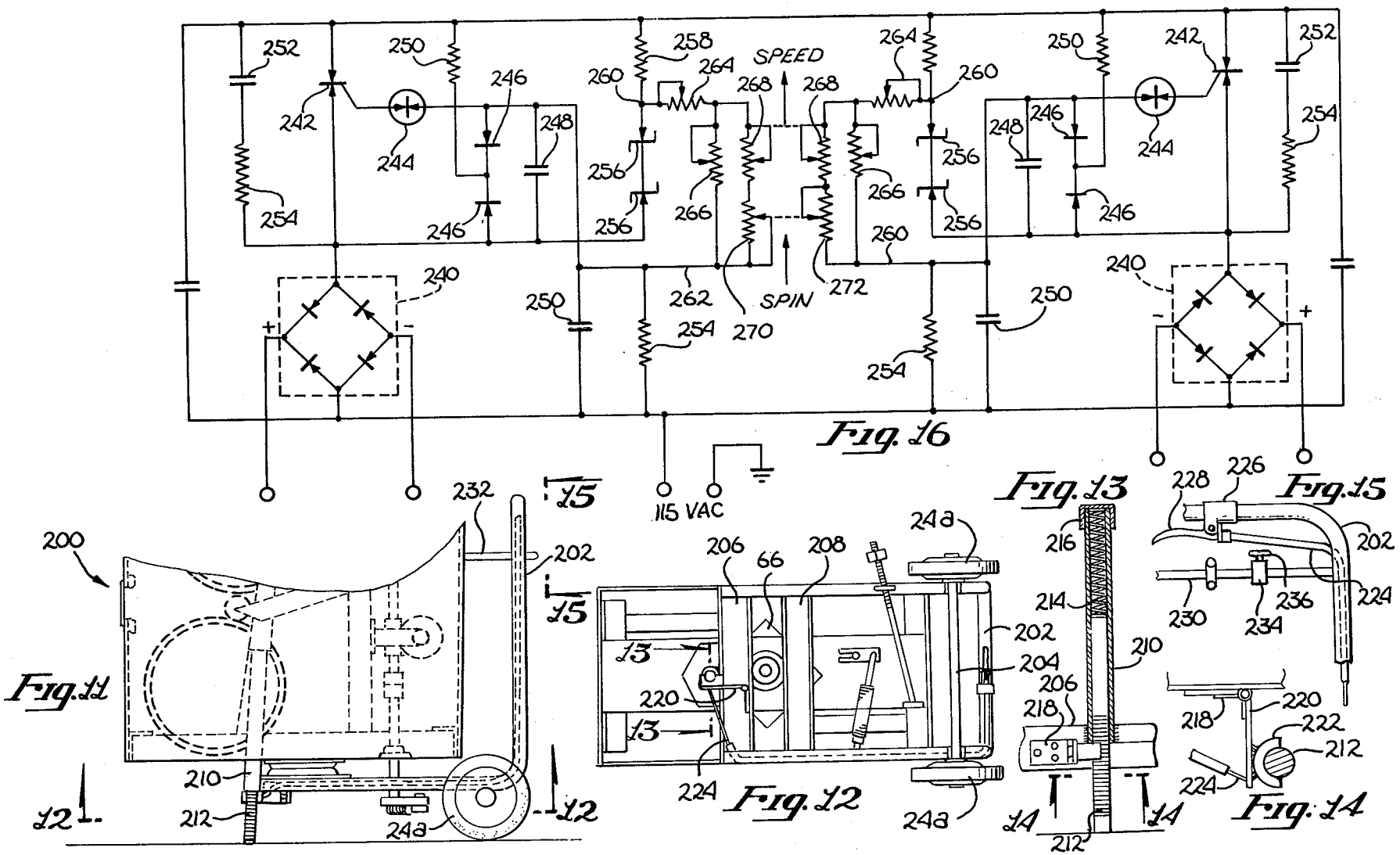
FIGS. 11 through 15 are views of an alternate embodiment of the tennis ball throwing machine.
FIG. 16 is a circuit diagram for a motor speed controller having independent ball speed and ball spin controls.

Now referring to FIG. 16, a unique circuit for the motor speed controllers for motors 82 and 84 may be seen. In particular, this circuit utilizes a pair of generally conventional SCR motor controller circuits which have their controls coupled in such a way as to provide independent controls for the speed of each throw and for the spin applied to each throw. Each controller, except for the control thereto, is of relatively conventional design utilizing a diode bridge 240 driven by a triac 242 controlled by a trigger comprising diac 244, diodes 246, capacitors 248, 250 and 252 and resistors 254, and a network about to be described controlling the phase of the trigger to the SCR 242 through the rate of charging of capacitor 248. In particular, zener diodes 256 in combination with resistor 258 effectively provide a reference voltage at point 260 so that the resistance between point 260 and lines 262 determines the charging rate for capacitor 248, and thus the switching point for the SCR's 242. The resistance between points 260 and lines 262 is determined by variable resistors 264, 266 and 268 as well as variable resistors 270 and 272. It will be noted that the two variable resistors 268 are disposed on a common shaft with the wiper of the potentiometric devices each coupled to the same end of the resistance element so that both variable resistors are simultaneously increased or decreased upon rotation of the adjustment shaft. However, though the variable resistors 270 and 272 are also coupled to a common shaft, the wipers of these two variable resistors are coupled to opposite ends of the respective resistance elements. Therefore though the two variable resistors will have the same resistance at the midpoint, one resistance will increase and one resistance will decrease as the adjustment is varied therefrom.

Variable resistors 264 and 266 for each SCR controller provide adjustment means for adjusting the maximum obtainable speed and the minimum attainable speed by the respective controller, thereby defining limits commensurate with the use of such devices in the present invention, and further providing a means for balancing the two controllers so as to achieve zero spin at the zero spin setting. Thereafter adjustment of the manual control for the two variable resistors 268 will provide an increase or decrease in the speed of both motors 82 and 84 to increase or decrease the speed of the throw. Adjustment of the manual control for variable resistors 270 and 272 will cause one motor to increase in speed and the other to decrease in speed, thereby maintaining the speed of the throw, but applying a top spin or a back spin dependent upon the direction and extent of the adjustment. Since the zero spin condition is set at approximately mid-range on the adjustment for variable resistors 270 and 272, substantial back spin or top spin may be achieved as desired through a single control. Accordingly, adjustments for spin and speed have been separated into individual controls, providing greater flexibility and ease of use of the device. It should be noted also that while this feature of the present invention has been described in detail herein with respect to rotary type variable resistance elements as used with respect to SCR motor speed controllers, other control elements and controllers might also be used, the essential feature being the integration of the speed control for two controllers through a first control providing the same control function to both controllers, and a second control providing a differential control input to the two controllers.

Obviously while only specific embodiments of the present invention have been disclosed and described in detail herein, it will be obvious to those skilled in the art that various changes in form and detail may be made therein without departing from the spirit and scope of the invention.

I claim:

1. A tennis ball throwing machine comprising:

a lower frame assembly;

an upper frame assembly;

bearing means between said upper and lower frame assemblies for allowing relative oscillation therebetween about a first approximately vertical axis;

first and second variable speed motors disposed one above the other on said upper frame assembly, said motors being disposed each with its shaft axis approximately in a horizontal disposition, each of said motors having speed controllers;

first and second impeller wheels, each mounted on the shaft of one of said first and second motors, said first and second impeller wheels being substantially coplanar and having a closest separation somewhat less than the diameter of a tennis ball;

a receptacle for a supply of tennis balls generally disposed at the top of and coupled to said upper frame assembly;

an upper shaft assembly coupled to said upper frame assembly approximately parallel to said first vertical axis;

a third motor for driving said upper shaft assembly in rotation, the controls for said first, second and third motors being located remotely and coupled to said machine through a cable;

delivery means coupled to the upper portion of said upper shaft assembly and cooperatively disposed with respect to the lower region of said receptacle for periodically delivering tennis balls from said receptacle to a chute means for conveying tennis balls to said point of closest separation of said impeller wheels;

a lower shaft assembly coupled to said upper frame assembly and having a third axis parallel to and displaced from said first axis, said lower shaft assembly having a crank lever thereon coupled to said lower frame assembly through a connecting assembly to cause oscillation of said upper frame assembly with respect to said lower frame assembly about said first axis upon rotation of said lower shaft assembly; and said delivery means being independent of the direction of rotation of said third motor, said controls for said third motor including a control for reversing said third motor, said oscillating means being driven by said third motor through a unidirectional clutch, whereby reversal of said third motor will stop said oscillation and not said delivery means.

2. The machine of claim 1 wherein said speed controllers comprise a first manually operable means for controlling the average speed of said first and second motors, and a second manually operable means for controlling the difference in speed between said first and second motors.

3. The machine of claim 1 further comprised of a motor speed control means for said third motor.

4. The machine of claim 1 wherein said unidirectional clutch provides a unidirectional drive for said oscillating means which has a fixed angle of reference with respect to said delivery means.

5. The machine of claim 4 wherein said lower frame assembly includes a stand motor means for electrically varying the angle between the ground and said first frame assembly.

6. The machine of claim 5 wherein said stand motor means includes a fourth motor and a pair of reversing switch means, said reversing switch means being adjustable in position and operative to cause adjustable oscillation of said angle between said first frame assembly and the surface on which it rests.

7. The machine of claim 5 further comprised of a control for said stand motor means located remotely and coupled to said machine through a cable.

8. The machine of claim 1 further comprised of an adjustment means for limiting the angle of rotation of said upper frame assembly with respect to said lower frame assembly in one direction, and wherein said connecting assembly is an extendable means which may be encouraged to different lengths.

9. The machine of claim 1 wherein said lower frame assembly includes a stand and first and second support wheels, said stand comprising a substantially vertical tube coupled to said lower frame assembly, a rod within said tube and spring loaded toward a downward position, and means for locking said rod at various selected positions.

10. A tennis ball throwing machine comprising:

a lower frame assembly;

an upper frame assembly;

a bearing means between said upper and said lower frame assemblies for allowing relative oscillation therebetween about an approximately vertical axis;

first and second independentally controllable variable speed motors disposed one above the other on said upper frame assembly, said motors being disposed each with its shaft axis approximately in a horizontal disposition, first and second impeller wheels, each mounted on the shaft of one of said first and second motors, said first and second impeller wheels being substantially coplanar and having a closest separation somewhat less than the diameter of a tennis ball;

a receptacle for a supply of tennis balls generally disposed at the top of and coupled to said upper frame assembly;

delivery means driven by a third motor for periodically delivering tennis balls from said receptacle to a position adjacent said point of closest separation of said impeller wheels;

oscillating means driven by said third motor synchronized with said delivery means for oscillating said upper frame assembly with respect to said lower frame assembly through a predetermined angle and at a frequency which is one-half the frequency of said delivery means; and wherein the controls for said first, second and third motors are located remotely and coupled to said machine through a cable, said delivery means being independent on the direction of rotation of said third motor, said controls for said third motor including a control for reversing said third motor, said oscillating means being driven by said third motor through a unidirectional clutch, whereby reversal of said third motor will stop said oscillation and not said delivery means.

11. The machine of claim 10 wherein said unidirectional clutch provides a unidirectional drive for said oscillating means which has a fixed angle of reference with respect to said delivery means.

* * * * *